United States Patent [19]

Berger

[11] Patent Number: 4,729,195

[45] Date of Patent: Mar. 8, 1988

[54] HAND GRIPPING MACHINE WITH A SUCTION DEVICE

[75] Inventor: Günther Berger, Notzingen, Fed. Rep. of Germany

[73] Assignee: Robert Bosch GmbH, Stuttgart, Fed. Rep. of Germany

[21] Appl. No.: 35,905

[22] Filed: Apr. 2, 1987

[30] Foreign Application Priority Data

Jun. 14, 1986 [DE] Fed. Rep. of Germany ..... 3620136

[51] Int. Cl.[4] ..... B24B 23/00

[52] U.S. Cl. ..... 51/170 MT; 51/273

[58] Field of Search ..... 51/169, 170 MT, 170 R, 51/170 T, 273

[56] References Cited

U.S. PATENT DOCUMENTS

| | | | |
|---|---|---|---|
| 2,639,564 | 5/1953 | Atkin | 51/170 MT |
| 2,683,336 | 7/1954 | Scace | 51/170 MT |
| 4,624,078 | 11/1986 | Rijen et al. | 51/170 MT |

FOREIGN PATENT DOCUMENTS

| | | | |
|---|---|---|---|
| 1189405 | 3/1965 | Fed. Rep. of Germany | 51/170 T |
| 2745129 | 4/1979 | Fed. Rep. of Germany | 51/170 MT |

*Primary Examiner*—Roscoe V. Parker

*Attorney, Agent, or Firm*—Michael J. Striker

[57] ABSTRACT

A hand-held grinding machine with a device for the suction of grinding dust comprises a motor with a motor shaft, an eccentric drive for driving a support of a grinding sheet. The machine further includes a fan wheel which carries an element for compensating for imbalance mass of the eccentric drive.

14 Claims, 2 Drawing Figures

HAND GRIPPING MACHINE WITH A SUCTION DEVICE

BACKGROUND OF THE INVENTION

The present invention relates to a hand-held grinding machine.

Hand grinding machines of the type under discussion include a suction device for sucking dust produced during the grinding process, an eccentric drive for driving a grinding sheet support and a fan wheel.

One of conventional grinding machines of the foregoing type has been disclosed in European patent application No. 0,138,278. The disadvantage of this known grinding machine is that a great number of structural components arranged one after another are required in order to transmit the drive movement of the motor shaft to the support of the grinding sheet and also to provide a suction air flow. This requires a relatively large structure height.

Furthermore, the mass compensation due to the provision of the fan wheel is not ideal in the known grinding machine because the balancing mass act far from the imbalance mass. Therefore a tilting torgue is produced from the action of the imbalance mass and the compensating mass, which unfavorably affects the grinding process.

SUMMARY OF THE INVENTION

It is an object of the present invention to provide an improved hand-held grinding machine.

It is another object of the invention to provide a grinding machine which is simple and compact.

These and other objects of the invention are attained by a hand-held grinding machine, which comprises a motor having a motor shaft; a grinding sheet support; an eccentric drive for said support, connected to said motor shaft; and a fan wheel which has an imbalance mass compensated by a mass of said eccentric drive. Said wheel has a bore concentrical with the motor shaft and receiving an end of the motor shaft, and a recess eccentrical to said bore. A pin is received in said recess via at least one bearing, said pin holding said grinding sheet support.

Said fan wheel has vanes and an air guiding ring which forms a portion of an end face of the grinding sheet support and has a varying thickness for compensating for imbalance mass.

The fan wheel may have vanes of various thickness for compensating for mass imbalance.

At least one vane may be omitted to compensate for mass imbalance.

The motor shaft may be supported in a machine housing via the fan wheel.

One ball bearing or two bearings, of which one is a ball bearing and another one is a needle bearing, may be positioned in the fan wheel to support said pin therein.

The fan wheel may be formed of good heat-conductive material.

Two rows of air-guiding vanes may be provided in the fan wheel, of which one row serves for dust suction and cooling the bearings and another row serves for cooling the motor.

Air-admitting openings may be provided in the fan wheel and the housing.

Due to the provision of the small fan wheel with the compensating mass for the drive of the grinding sheet support, the imbalance masses and mass-compensating masses can be interchanged.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
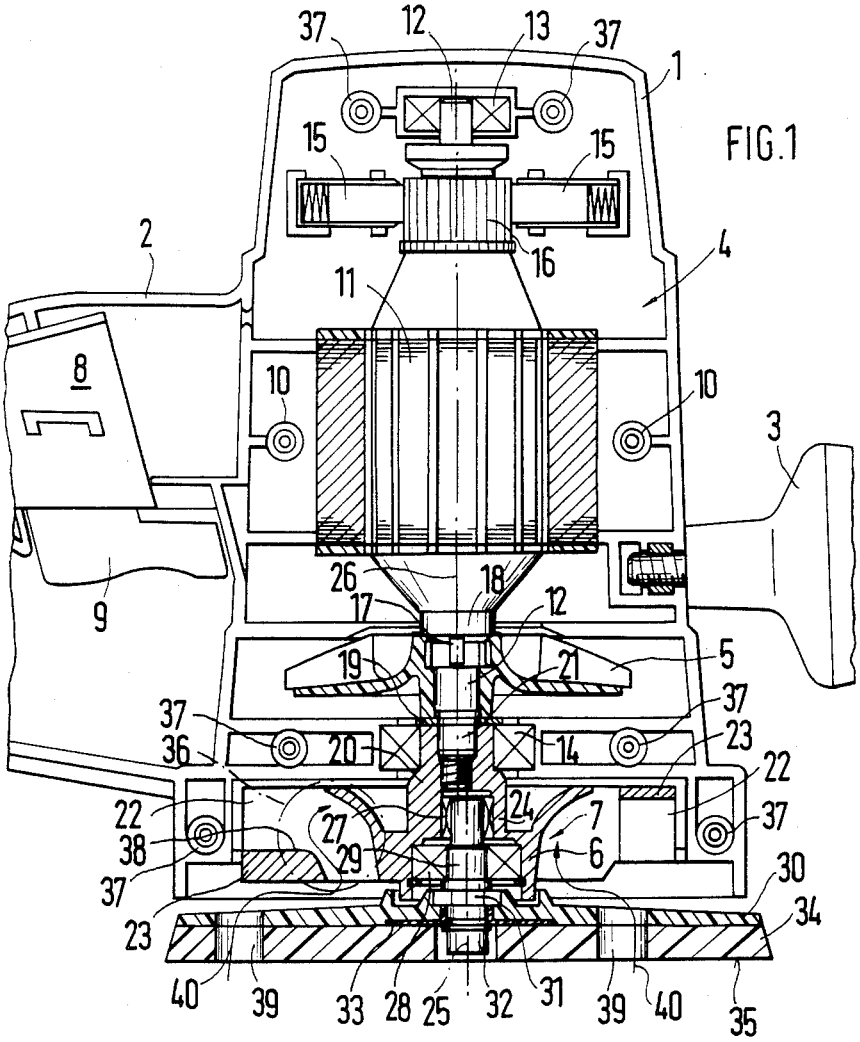
FIG. 1 is an axial sectional view of the first embodiment of the hand-held grinding machine according to the invention.

Referring now to the drawings in detail, and firstly to FIG. 1 thereof which shows the first embodiment of the invention, it will be seen that the grinding machine has a housing 1 having a hand grip 2 and an additional handrip 3. A drive motor 4 with a fan wheel 5 which serves to cool the motor, a further fan wheel 6 and an eccentric drive 7 are accommodated in the housing 1.

A switch 8 with an actuation knob 9 is mounted in the handgrip 2. Motor 4 is screwed by bolts 10 in the motor housing. The rotor 11 of motor 4 is supported on a motor shaft 12 which in turn is supported in ball bearings 13 and 14. Carbon brushes 15 correspond to a collector 16 of the rotor 11. The fan wheel 5 is rotation-fixedly supported on the motor shaft 12 by means of a key 17. A collar 18 of the motor shaft 12 and a safety washer 19 inserted in a recess of the motor shaft 12 secure the fan wheel 5 against the axial displacement. The same safety washer 19 also serves as a stop for a hub 20 of the fan wheel 6. Hub 20 is secured at the end of the motor shaft 12 by means of a threaded pin 21. The extension of the hub 20 receives the ball bearing 14 which forms the second bearing for the motor shaft. Accordingly this ball bearing 14 is held on the other side in the housing 1.

The hub 20 carries fan vanes 22,and a ring 23 which can be of various thickness. Hub 20 also includes a stepped sylindrical recess 24, the central axis of which is parallel to the central axis 26 of the motor shaft 12. Recess 24 is positioned eccentrically in respect to the motor shaft 12. This recess receives, via two bearings 27 and 28, a pin 29, to which a grinding sheet support 30 is connected. A hexagonal portion 31 of the pin 29 acts as a rotation transmitter. Hexagonal portion 31 is fit in a respective recess of the grinding paper support 30 whereas a bolt 32 screwed into the threaded bore, provided in the pin 29, holds the grinding sheet support 30 on the pin 29 by a washer 33.

The grinding sheet support 30 includes a soft pad 34 to which a suitable grinding sheet 35 is glued or otherwise secured, for example by Velcro means.

A circle 36 indicated by dash-dotted line shows schematically an air outlet connection in housing 1, though which connection an exhaust air can flow outside.

Housing 1 is formed of two cover-shaped halves which are held together by means of screw connections 37. Bolts 10 also serve to connect these two housing halves to each other. An assymetrical material concentration or thickening 38 of the ring 23 serves here as a compensating or balancing mass for the eccentrically positioned pin 29 with the grinding sheet support 30 carried thereby. The compensating mass can be additionally obtained such that in the region of the thickening 38 of the ring 23 at least one of the vanes 22 would be thicker than others, and at least one vane diametrically opposing the thicker vane would be omitted. A compensation for a dynamic imbalance can be further obtained by that the portion of the ring 23, which is diametrically opposed to the thickening 38, would be axially offset relative to the thickening 38. Openings 39 which extend through the grinding sheet 35, pad 34 and grinding sheet support 30 form a part of trajectory or path of the suction, which is indicated by arrow 40.

As clear from FIG. 1, imbalance producing masses and imbalance-compensating masses can be reversed. It is also clear that fan wheel 6 which has three functions has also a space-saving effect.

Figure 2:
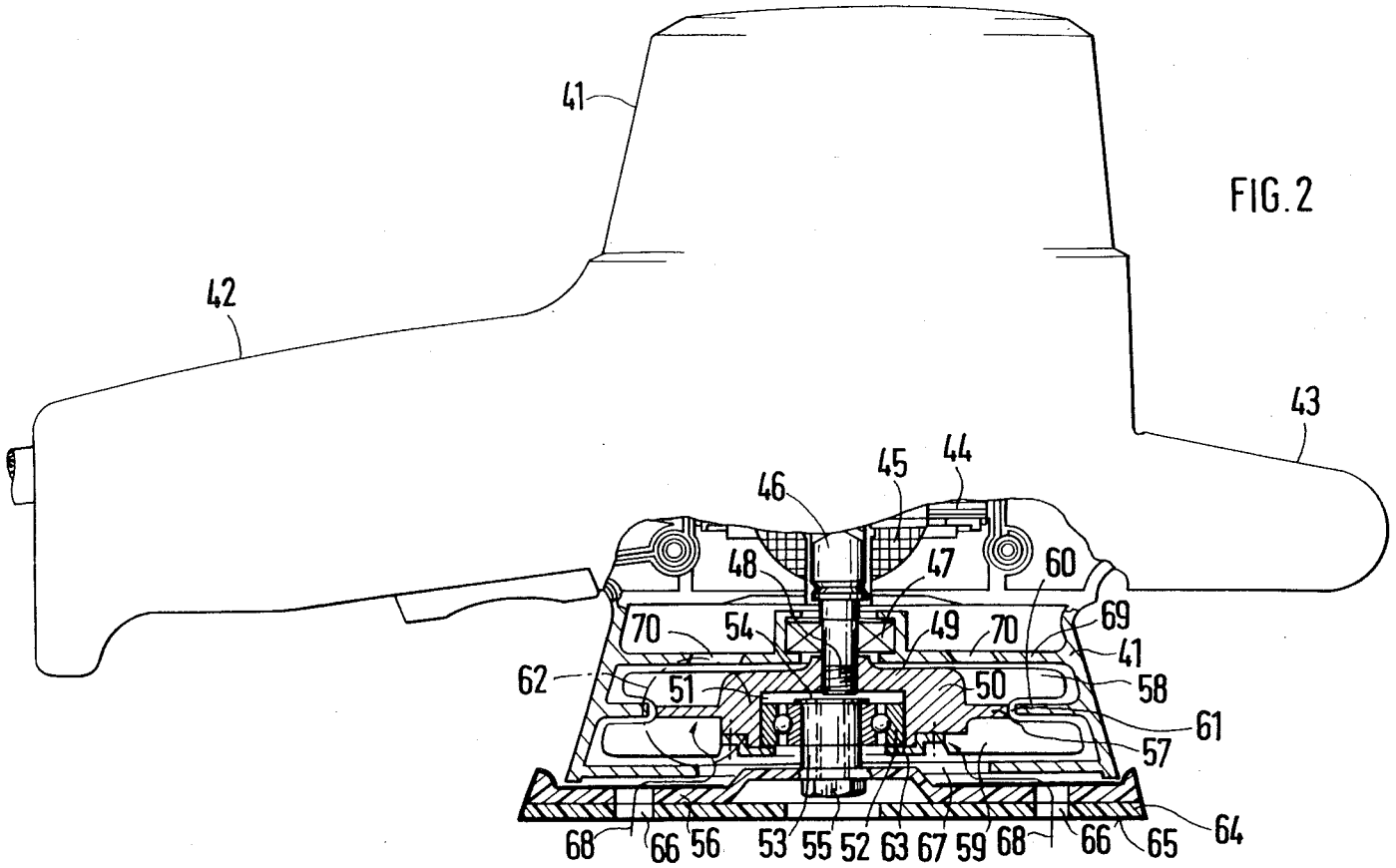
FIG. 2 is a partial axial sectional view of the second embodiment of this invention.

In the embodiment shown in FIG. 2, housing 41 is provided with a main handgrip 42 and an additional handgrip 43 with a motor 44. A motor shaft 46 of this motor which carries a rotor 45 is supported in housing 41 by means of a ball bearing 47. The end of the motor shaft 46 provided with a threaded pin 48 is screwed in a hub 49 of a fan wheel 50. A ball bearing 52 is inserted in an eccentrical recess 51 of the hub 49. The ball bearing 52 receives a pin 53 which is secured against an axial displacement, by means of a safety washer 54. Bolt 55 can be screwed in the pin 53. Bolt 55 in turn rigidly connects a grinding sheet support 56 with the pin 53. Hub 49 forms a disk-shaped rib or web 57 which is concentrical to the motor shaft 46. This rib 57 separates two rows of vanes 58 and 59 from each other. Both rows of vanes 58, 59 are supported by the hub 49. An annular rib 60 formed on the inner wall of the housing 41 engages in a similar manner in a respective recess 61 provided between vanes 58 and 59. An exhaust air connection indicated by circle 62 overlaps both rows of vanes 58 and 59.

A cover 63 which is screwed to the end face of the hub 49 rigidly holds the ball bearing 52 in the recess 51.

Similarly to the embodiment of FIG. 1, the grinding sheet support 56 has a soft pad 64 with a grinding sheet 65 connected thereto. Openings 66 are provided to guide therethrough the exhaust air. A central opening 67 formed in the end wall of the housing 41, which faces the grinding sheet support 56, defines a further path of exhaust air, which is indicated by arrow 68.

A housing wall 69 has openings 70 through which a cooling air flowing through the motor 44 towards the fan wheel 50 can pass to the row of vanes 58. This embodiment shows that by means of the single fan wheel 50 a suction air flow through the row of vanes 59 and a cooling air flow for the motor 44 through the row of vanes 58 can be generated. Both air flows pass towards the air exhaust connection encircled by reference s 2. Therefore, the embodiment of FIG. 2 is even more compact than that of FIG. 1 and presents a further improvement of the invention. The imbalance-compensating mass can be carried out in the device of FIG. 2 in the same manner by various thicknesses of the vanes or by the enlargement of the mass of the hub.

It will be understood that each of the elements described above, or two or more together, may also find a useful application in other types of hand-held grinding machines differing from the types described above.

While the invention has been illustrated and described as embodied in a hand-helf grinding machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A hand-held grinding machine, comprising a motor with a motor shaft; a grinding sheet support; an eccentric drive for said grinding sheet support and connected to said motor shaft; and a fan wheel having an imbalance mass compensated by an imbalance of said eccentric drive, said fan wheel having a bore concentrical to said motor shaft and receiving an end of said motor shaft, and a recess eccentrical with said bore; and a pin received in said recess via bearings, said pin holding said grinding sheet support.

2. The machine as defined in claim 1, said fan wheel having vanes, and an air guiding ring carried by said vanes, said ring forming a portion of an end face of said fan wheel which faces said grinding sheet support and has various thickness for compensating for a mass imbalance.

3. The machine as defined in claim 1, wherein said fan wheel has vanes of various thickness for compensating for a mass imbalance.

4. The machine as defined in claim 1, wherein said fan wheel is formed with at least one vane omitted for compensating for a mass imbalance.

5. The machine as defined in claim 2, wherein said fan wheel has vanes of various thickness for compensating for mass imbalance.

6. The machine as defined in claim 2, wherein said fan wheel is formed with at least one vane omitted for compensating for mass imbalance.

7. The machine as defined in claim 1, wherein said fan wheel has vanes of various thickness and at least one of the vanes is omitted for compensating for mass imbalance.

8. The machine as defined in claim 1, said fan wheel having vanes of various thickness and at least one of the vanes being omitted for compensating for mass imbalance, said fan wheel further including an air guiding ring carried by said vanes, said ring forming a portion of an end face of said fan wheel, which faces said grinding sheet support and has various thickness for compensating for mass imbalance.

9. The machine as defined in claim 1, including a housing in which said motor shaft is supported via said fan wheel.

10. The machine as defined in claim 1, including a housing, said motor shaft and said fan wheel enclosing said shaft being supported in said housing by a ball bearing.

11. The mcahine as defined in claim 1, wherein said bearings include a ball bearing and a needle bearing positioned in said fan wheel and supporting said pin therein.

12. The machine as defined in claim 1, wherein said fan wheel is formed of a good heat-conductive material.

13. The machine as defined in claim 1, wherein said fan wheel includes two rows of air-guiding vanes, of which one row serves for dust suction and cooling said bearings and another row serves for cooling the motor.

14. The machine as defined in claim 13, further including air guide means (66, 67, 69), and wherein a common exhaust air opening (62) is formed between said housing and said fan wheel, said two rows of vanes generating air flows which are guided by said air guide means and said common opening.

* * * * *

US004729195C1

(12) EX PARTE REEXAMINATION CERTIFICATE (6325th)

United States Patent

Berger

(10) Number: US 4,729,195 C1

(45) Certificate Issued: Jul. 29, 2008

(54) HAND GRIPPING MACHINE WITH A SUCTION DEVICE

(75) Inventor: Günther Berger, Notzingen (DE)

(73) Assignee: Robert Bosch GmbH, Stuttgart (DE)

Reexamination Request:
No. 90/008,601, Apr. 24, 2007

Reexamination Certificate for:

| | |
|---|---|
| Patent No.: | **4,729,195** |
| Issued: | **Mar. 8, 1988** |
| Appl. No.: | **07/035,905** |
| Filed: | **Apr. 2, 1987** |

(30) Foreign Application Priority Data

Jun. 14, 1986 (DE) ..... 3620136

(51) Int. Cl.
*B24B 55/10* (2006.01)
*B24B 55/00* (2006.01)

(52) U.S. Cl. ..... 451/357; 451/456

(58) Field of Classification Search ..... None
See application file for complete search history.

(56) References Cited

U.S. PATENT DOCUMENTS

| | | | | | |
|---|---|---|---|---|---|
| 2,639,564 | A | * | 5/1953 | Atkin | 451/357 |
| 2,683,336 | A | * | 7/1954 | Scace | 451/357 |
| 2,942,384 | A | * | 6/1960 | Higley | 451/357 |
| 3,084,364 | A | | 4/1963 | Hutchins | |
| 3,496,680 | A | * | 2/1970 | Hutchins | 451/357 |
| 3,793,776 | A | * | 2/1974 | Sadow et al. | 451/357 |
| 3,938,283 | A | | 2/1976 | Keith, Jr. | |
| 4,102,084 | A | | 7/1978 | Bloomquist | |
| 4,322,921 | A | | 4/1982 | Maier | |
| 4,355,487 | A | * | 10/1982 | Maier et al. | 451/357 |
| 4,381,628 | A | * | 5/1983 | Dicke | 451/356 |
| 4,549,371 | A | | 10/1985 | Hakoda | |
| 4,624,078 | A | * | 11/1986 | Van Rijen et al. | 451/357 |
| 4,754,575 | A | | 7/1988 | Schneider | |

FOREIGN PATENT DOCUMENTS

| | | |
|---|---|---|
| DE | 1 189 405 | 3/1965 |
| DE | 27 45 129 A1 | 4/1979 |
| DE | 36 15 799 A1 | 11/1987 |
| EP | 0 138 278 A2 | 4/1985 |
| EP | 0 138 278 B1 | 6/1988 |
| GB | 787365 | 12/1957 |
| JP | 56-52171 | 5/1981 |
| JP | 57-28871 | 2/1982 |
| JP | 60-7953 | 1/1985 |
| JP | 62-1855 | 1/1987 |
| SE | 162 307 | 2/1958 |

OTHER PUBLICATIONS

Complaint, *Robert Bosch Tool Corporation* vs. *Black & Decker Inc. and Black & Decker (U.S.) Inc.,* Civil Action No. 1:06–cv–04746 (Aug. 31, 2006).

Black & Decker's Answer and Counterclaims, *Robert Bosch Tool Corporation* vs. *Black & Decker Inc. and Black & Decker (U.S.) Inc.,* Civil Action No. 1:06–cv–04746 (Nov. 6, 2006).

Plaintiff's Reply to Counterclaims of Defendants, *Robert Bosch Tool Corporation* vs. *Black & Decker Inc. and Black & Decker (U.S.) Inc.,* Civil Action No. 1:06–cv–04746 (Nov. 29, 2006).

Plaintiff Robert Bosch Tool Corporation's First Set of Interrogatories to Defendants, *Robert Bosch Tool Corporation* vs. *Black & Decker Inc. and Black & Decker (U.S.) Inc.,* Civil Action No. 1:06–cv–04746 (Feb. 28, 2007).

(Continued)

*Primary Examiner*—Jeffrey L. Gellner

(57) ABSTRACT

A hand-held grinding machine with a device for the suction of grinding dust comprises a motor with a motor shaft, an eccentric drive for driving a support of a grinding sheet. The machine further includes a fan wheel which carries an element for compensating for imbalance mass of the eccentric drive.

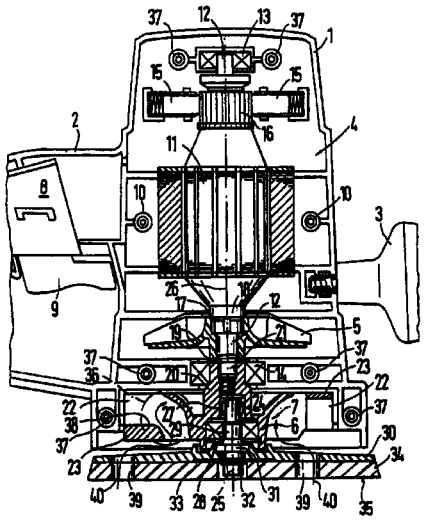

OTHER PUBLICATIONS

Plaintiff Robert Bosch Tool Corporation's First Set of Requests for Production of Documents and Things to Defendants, *Robert Bosch Tool Corporation* vs. *Black & Decker Inc. and Black & Decker (U.S.) Inc.,* Civil Action No. 1:06–cv–04746 (Feb. 28, 2007).

Joint Initial Status Report, *Robert Bosch Tool Corporation* vs. *Black & Decker Inc. and Black & Decker (U.S.) Inc.,* Civil Action No. 1:06–cv–04746 (Mar. 8, 2007).

Black & Decker's First Set of Requests for Production (Nos. 1–47), *Robert Bosch Tool Corporation* vs. *Black & Decker Inc. and Black & Decker (U.S.) Inc.,* Civil Action No. 1:06–cv–04746 (Mar. 9, 2007).

Black & Decker's First Set of Interrogatories (Nos. 1–12), *Robert Bosch Tool Corporation* vs. *Black & Decker Inc. and Black & Decker (U.S.) Inc.,* Civil Action No. 1:06–cv–04746 (Mar. 9, 2007).

Plaintiff Robert Bosch Tool Corporation's Disclosures Under Fed. R. Civ. P. 26(a)(1), *Robert Bosch Tool Corporation* vs. *Black & Decker Inc. and Black & Decker (U.S.) Inc.,* Civil Action No. 1:06–cv–04746 (Mar. 19, 2007).

Black & Decker's Rule 26(a)(1) Initial Disclosures, *Robert Bosch Tool Corporation* vs. *Black & Decker Inc. and Black & Decker (U.S.) Inc.,* Civil Action No. 1:06–cv–04746 (Mar. 20, 2007).

Black & Decker's Supplemental Rule 26(a)(1) Initial Disclosures, *Robert Bosch Tool Corporation* vs. *Black & Decker Inc. and Black & Decker (U.S.) Inc.,* Civil Action No. 1:06–cv–04746 (Mar. 26, 2007).

Black & Decker's Response to Bosch's First Set of Interrogatories, *Robert Bosch Tool Corporation* vs. *Black & Decker Inc. and Black & Decker (U.S.) Inc.,* Civil Action No. 1:06–cv–04746 (Apr. 2, 2007).

Black & Decker's Response to Bosch's First Set of Requests for Production of Documents, *Robert Bosch Tool Corporation* vs. *Black & Decker Inc. and Black & Decker (U.S.) Inc.,* Civil Action No. 1:06–cv–04746 (Apr. 2, 2007).

Bosch's Answers to Black & Decker's First Set of Interrogatories (Nos. 1–12), *Robert Bosch Tool Corporation* vs. *Black & Decker Inc. and Black & Decker (U.S.) Inc.,* Civil Action No. 1:06–cv–04746 (Apr. 9, 2007).

Bosch's Response to Black & Decker's First Set of Requests for Production (Nos. 1–47), *Robert Bosch Tool Corporation* vs. *Black & Decker Inc. and Black & Decker (U.S.) Inc.,* Civil Action No. 1:06–cv–04746 (Apr. 9, 2007).

Plaintiff Robert Bosch Tool Corporation's Second Set of Requests for Production of Documents and Things to Defendants, *Robert Bosch Tool Corporation* vs. *Black & Decker Inc. and Black & Decker (U.S.) Inc.,* Civil Action No. 1:06–cv–04746 (Jun. 6, 2007).

Black & Decker's Response to Bosch's Second Set of Requests for Production of Documents and Things, *Robert Bosch Tool Corporation* vs. *Black & Decker Inc. and Black & Decker (U.S.) Inc.,* Civil Action No. 1:06–cv–04746 (Jul. 5, 2007).

Black & Decker's Notice of Motion for a Stay Pending Reexamination, *Robert Bosch Tool Corporation* vs. *Black & Decker Inc. and Black & Decker (U.S.) Inc.,* Civil Action No. 1:06–cv–04746 (Jul. 10, 2007).

Black & Decker's Motion for a Stay Pending Reexamination, *Robert Bosch Tool Corporation* vs. *Black & Decker Inc. and Black & Decker (U.S.) Inc.,* Civil Action No. 1:06–cv–04746 (Jul. 10, 2007).

Notification of Docket Entry, *Robert Bosch Tool Corporation* vs. *Black & Decker Inc. and Black & Decker (U.S.) Inc.,* Civil Action No. 1:06–cv–04746 (Jul. 19, 2007).

Memorandum in Opposition to Defendants' Motion for a Stay Pending Reexamination of Plaintiff's Patent, *Robert Bosch Tool Corporation* vs. *Black & Decker Inc. and Black & Decker (U.S.) Inc.,* Civil Action No. 1:06–cv–04746 (Aug. 9, 2007).

Declaration of Keith M. Sorge Supporting Plaintiffs' Memorandum in Opposition to Defendant's Motion for a Stay Pending Reexamination of Plaintiff's Patent, *Robert Bosch Tool Corporation* vs. *Black & Decker Inc. and Black & Decker (U.S.) Inc.,* Civil Action No. 1:06–cv–04746 (Aug. 9, 2007).

Black & Decker's Reply in Support of its Motion for a Stay Pending Reexamination, *Robert Bosch Tool Corporation* vs. *Black & Decker Inc. and Black & Decker (U.S.) Inc.,* Civil Action No. 1:06–cv–04746 (Aug. 20, 2007).

Notification of Docket Entry, *Robert Bosch Tool Corporation* vs. *Black & Decker Inc. and Black & Decker (U.S.) Inc.,* Civil Action No. 1:06–cv–04746 (Sep. 21, 2007).

Stipulated Protective Order for Confidential Information, *Robert Bosch Tool Corporation* vs. *Black & Decker Inc. and Black & Decker (U.S.) Inc.,* Civil Action No. 1:06–cv–04746 (Sep. 25, 2007).

Docket Entry Text—Enter stipulated protective order for confidential information, *Robert Bosch Tool Corporation* vs. *Black & Decker Inc. and Black & Decker (U.S.) Inc.,* Civil Action No. 1:06–cv–04746 (Sep. 25, 2007).

Bosch's Supplemental Answer to Black & Decker's First Set of Interrogatories, *Robert Bosch Tool Corporation* vs. *Black & Decker Inc. and Black & Decker (U.S.) Inc.,* Civil Action No. 1:06–cv–04746 (Feb. 12, 2008).

Black & Decker's Second Set of Interrogatories (No. 13), *Robert Bosch Tool Corporation* vs. *Black & Decker Inc. and Black & Decker (U.S.) Inc.,* Civil Action No. 1:06–cv–04746 (Feb. 21, 2008).

Plaintiff Robert Bosch Tool Corporation's Third Set of Requests for Production of Documents and Things to Defendants, *Robert Bosch Tool Corporation* vs. *Black & Decker Inc. and Black & Decker (U.S.) Inc.,* Civil Action No. 1:06–cv–04746 (Feb. 28, 2008).

"Eccentric," Random House Webster's College Dictionary, p. 416 (2001).

"Receive," and "recess," Random House Webster's College Dictionary, p. 1102 (2001).

"Via," Random House Webster's College Dictionary, p. 1454 (2001).

"Pin," Random House Webster's College Dictionary, pp. 1004–1005 (2001).

"Support," Random House Webster's College Dictionary, p. 1316 (2001).

"Eccentric," Webster's Ninth New Collegiate Dictionary, p. 394 (1989).

"Via," Webster's Ninth New Collegiate Dictionary, p. 1312 (1989).

"Pin," Webster's Ninth New Collegiate Dictionary, pp. 892 and 893 (1989).

"Support," Webster's Ninth New Collegiate Dictionary, p. 1186 (1989).

"Hold," Webster's Ninth New Collegiate Dictionary, p. 575 (1989).

"Hold," Merriam–Webster's Collegiate Dictionary, 10th Edition, p. 552 (1995).

"Hold," Random House Webster's Unabridged Dictionary, 2nd Edition, p. 910 (2001).
Pages 1 and 3–8 of Expert Report of Paul J. Strykowski, Expert on behalf of Robert Bosch GmbH in arbitration between Robert Bosch GmbH and Black & Decker.
Black & Decker Owner's Manual 4010 Professional Palm Grip Finishing Sander (Apr. 1984) and 16 photos of Black & Decker 4010 Sander.
Exploded part diagram of Black & Decker 4010 Sander, 1 page (Apr. 1983).
"Recess," ASM Materials Engineering Dictionary, p. 362 (1992).
"Screw," Key Terms in Technology Studies, pp. 216–217 (1990).
Academic Press Dictionary of Science and Technology, pp. 1651, 1808, 1931 (1992).
"Recess," The Wordsworth Dictionary of Science and Technology, p. 746 (1995).
"Screw," McGraw–Hill Encyclopedia of Engineering, pp. 948–954 (1983).
Machinery's Handbook, 24th Edition, pp. 1484–1499, 1402–1469 (1992).
Machinery's Handbook, 22nd Revised Edition, pp. 1020–1037, 1126–1187 (1984).
Machinery's Handbook, 20th Edition, pp. 1142–1149, 1196–1257 (1975).
Standard Handbook for Mechanical Engineers, 7th Edition, pp. 8–12—8–33 (1967).
McGraw–Hill Dictionary of Mechanical and Design Engineering, pp. 251, 299 (1984).
File History of German application DE 36 28 136 to which U.S. Patent No. 4,729,195 claims priority (in German and Certified English translation).
File History of UK Patent No. 2 191 429 which claims priority to German application DE 36 201 36.
File History of IT Patent No. 1 204 704 which claims priority to German Application DE 36 201 36.
File History of Japanese patent application No. 62–122700 which claims priority to German application DE 36 201 36.

* cited by examiner

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–14 is confirmed.

* * * * *